US010040076B2

(12) United States Patent
Mackel et al.

(10) Patent No.: US 10,040,076 B2
(45) Date of Patent: Aug. 7, 2018

(54) METHOD FOR CLARIFYING A FLOWABLE PRODUCT WITH A CENTRIFUGE HAVING DISCONTINUOUSLY OPENABLE SOLID-DISCHARGE OPENINGS

(71) Applicant: GEA MECHANICAL EQUIPMENT GMBH, Oelde (DE)

(72) Inventors: Wilfried Mackel, Lippetal-Herzfeld (DE); Markus Fleuter, Ennigerloh (DE); Josef Linckamp, Oelde (DE)

(73) Assignee: GEA MECHANICAL EQUIPMENT GMBH, Oelde (DE)

( * ) Notice: Subject to any disclaimer, the term of this patent is extended or adjusted under 35 U.S.C. 154(b) by 85 days.

(21) Appl. No.: 15/030,524

(22) PCT Filed: Oct. 20, 2014

(86) PCT No.: PCT/EP2014/072437
§ 371 (c)(1),
(2) Date: Apr. 19, 2016

(87) PCT Pub. No.: WO2015/059091
PCT Pub. Date: Apr. 30, 2015

(65) Prior Publication Data

US 2016/0263586 A1 Sep. 15, 2016

(30) Foreign Application Priority Data

Oct. 21, 2013 (DE) ..... 10 2013 111 576

(51) Int. Cl.
*B04B 1/14* (2006.01)
*B04B 11/04* (2006.01)

(52) U.S. Cl.
CPC ..... *B04B 1/14* (2013.01); *B04B 11/04* (2013.01)

(58) Field of Classification Search
CPC ..... B04B 1/14; B04B 11/04
(Continued)

(56) References Cited

U.S. PATENT DOCUMENTS 3,752,389 A 8/1973 Nilsson
4,475,897 A 10/1984 Bradtmöller
(Continued)

FOREIGN PATENT DOCUMENTS

DE 3147613 A1 6/1983
DE 3228074 A1 2/1984
(Continued)

OTHER PUBLICATIONS

International Search Report dated Feb. 2, 2015 in related International Application No. PCT/EP2014/072437.
(Continued)

*Primary Examiner* — Walter D. Griffin
*Assistant Examiner* — Shuyi S. Liu
(74) *Attorney, Agent, or Firm* — Patent Portfolio Builders PLLC

(57) ABSTRACT

A method is provided for clarifying a flowable starting product with a separator having a feed and at least one liquid discharge for continuously discharging at least one clarified liquid phase—a clear phase—and with discontinuously openable solid-discharge openings for discontinuously discharging the solid phase. The method involves the steps: a. setting or determining a starting time; b. repeatedly determining at least one actual value of a product-parameter of the clear phase derived from the drum; c. determining the time interval until the product-parameter actual value reaches or exceeds a product-parameter limit value; d. preferably initiating a solid discharge as a result of reaching or exceeding the product-parameter limit value; e. determining and setting an operating time interval by using the
(Continued)

determined calibrating time interval, the operating time interval being less than or greater than the ascertained calibrating time interval; and f. initiating at least one or more solid discharges each time the set operating time interval has elapsed.

20 Claims, 5 Drawing Sheets

(58) Field of Classification Search
USPC ..... 494/2, 3, 10
See application file for complete search history.

(56) References Cited

U.S. PATENT DOCUMENTS

| | | | | |
|---|---|---|---|---|
| 4,828,865 | A | 5/1989 | Kohlstette et al. | |
| 5,093,010 | A * | 3/1992 | Schilp | B04B 11/043 210/739 |
| 5,318,500 | A * | 6/1994 | Kelley | B01D 21/34 210/739 |
| 7,641,929 | B2 | 1/2010 | Spiekermeier et al. | |
| 8,557,316 | B2 | 10/2013 | Pecoroni et al. | |
| 2015/0045199 | A1 * | 2/2015 | Thorwid | B04B 1/08 494/2 |

FOREIGN PATENT DOCUMENTS

| | | | | |
|---|---|---|---|---|
| DE | 3620548 | A1 | 12/1987 | |
| DE | 10335191 | B3 | 5/2005 | |
| DE | 102008051499 | A1 | 4/2010 | |
| DE | 102008062055 | A1 | 6/2010 | |
| EP | 0431426 | A1 | 6/1991 | |
| EP | 2196266 | A2 | 6/2010 | |
| EP | 2644278 | A1 * | 10/2013 | B04B 1/08 |
| WO | 2008058340 | A1 | 5/2008 | |

OTHER PUBLICATIONS

Written Opinion dated Feb. 2, 2015 in related International Application No. PCT/EP2014/072437.

* cited by examiner

METHOD FOR CLARIFYING A FLOWABLE PRODUCT WITH A CENTRIFUGE HAVING DISCONTINUOUSLY OPENABLE SOLID-DISCHARGE OPENINGS

BACKGROUND AND SUMMARY OF THE INVENTION

Exemplary embodiment of the invention relate to a method for clarifying a flowable starting product with a separator with a rotatable drum having a feed, at least one liquid discharge for continuously discharging at least one clarified liquid phase, and discontinuously openable solid-discharge openings for continuously discharging the solid phase.

German patent document DE 32 28 074 A1 discloses a method allowing in an advantageous way control of a continuously evacuating clarifying separator with a drum. A product parameter—here the degree of turbidity of a clear phase running out from the drum—is determined and used to monitor the evacuation of the solids chamber of the drum. In this case, the solid phase is continuously evacuated. If the turbidity or the degree of turbidity in the clear phase becomes too high, a return of the clear phase into the drum takes place.

It is additionally also known to use a clarifying separator for clarifying liquids, in particular beverages, in which the solids are discontinuously evacuated with the aid of a piston slide valve for opening and closing discharge openings when the degree of turbidity measured by the photocell exceeds a certain limit value.

This method has also proven itself, such as for example in the clarification of beverages comprising turbid substances. It is problematic, however, that, when measuring the degree of turbidity of the clear phase, limit values have to be prescribed, the reaching of which often means that there is already an undesirably high proportion of turbid substances in the beverage when the evacuation of the solids takes place. This is so because it is only with difficulty that an incipient turbidity of the clear phase can be precisely determined by sensors.

An exemplary embodiment of the invention is directed to a method for clarifying a flowable starting product (AP) with a—self-evacuating—separator with a rotatable drum with a feed and at least one liquid discharge for continuously discharging at least one clarified liquid phase—a clear phase—and with discontinuously openable solid-discharge openings for discontinuously discharging the solid phase. The method involves the following steps: a. setting or determining a starting time; b. repeatedly determining at least one actual value of a product parameter of the clear phase (KP) drawn off from the drum; c. determining the calibrating time interval from the starting point until the time at which the product-parameter actual value or the difference quotient of the determined product-parameter actual values and the respective time intervals between the measurements reaches or exceeds a limit value, in particular a product-parameter limit value; d. preferably initiating a solid discharge as a consequence of reaching or exceeding the limit value, in particular the product-parameter limit value; e. determining and setting an operating time interval t(B) by means of the determined calibrating time interval t(K), the operating time interval t(B) being less than or equal to or greater than the determined calibrating time interval t(K); and f. initiating at least one or more solid discharges each time the set operating time interval t(B) has elapsed.

When starting up the drum, the time of step a. may be the starting time or the time of the beginning of the product feed into the drum. Otherwise, the time of the last solid evacuation is preferably used.

In this case, the calibrating time period may also be determined indirectly from the time of the solid evacuation or as the time period between two solid evacuations. The further solid evacuation of step d. is to this extent merely the consequence of the deviation of the product parameter from the setpoint value and is time-dependent on this event. In particular according to the measuring method of International patent document WO 2008/058340 A1, establishing when a value is below a limit value may be a suitable method with which the turbidity in a separate line to the outlet of the drum and/or in a bypass line or the like is measured.

The determination of the actual value of the product parameter may be performed, for example, by the quasi-continuous determination of measured values. It is however also possible to determine just some measured values at periodic times of somewhat greater intervals. As a result, the measured values can be used to determine a measuring curve, which allows a statement to be made concerning the change in the product parameter.

The initiation of the second solid discharge preferably ends the calibrating interval. The clear phase carried out in the calibrating interval corresponds qualitatively to the clear phase according to the prior art, since a change in the parameter in a significant way has already commenced. Therefore, in fact no qualitative change in comparison with the prior art is achieved during the calibrating interval. This improvement is made possible however by steps e) and f) now allowing other prescribed time settings to be made than is possible on the basis of the measurements alone, which is explained still more specifically further below on the basis of examples.

The determination and setting of the operating time interval may be performed by various mathematical operations. For instance, a preset time interval may be subtracted from the determined calibrating time interval. An analysis of the measuring curve, that is to say the variation over time of the measured values, over the calibrating time interval may also be performed by the evaluation unit or the end user and the setting of the operating time interval may be performed in dependence on this evaluation. Not least, a factorizing of the calibrating interval is also possible, the factor, which is multiplied by the calibrating time interval, preferably being less than 1. After the set operating interval has passed, a solid discharge is initiated. The solid discharge is consequently time-controlled and not initiated in dependence on a measurement.

In such a way—with the assumption of properties of the incoming product remaining the same, at least to the greatest extent—a solid evacuation may already take place when the change is not yet measurable or is just measurable. If the product parameter is, for example, the turbidity content of a clear phase, an increase in the turbidity or the degree of turbidity in the clear phase to a limit value is accepted once in the determination of the calibrating time interval. Several further evacuations are then performed in a time-controlled manner such that this limit value is not reached in the first place, and the turbidity preferably lies well below it. In such a way, the turbidity content of the clear phase drawn off is altogether reduced and the quality of the clear phase drawn off is improved overall. Only after several time-controlled solid evacuations is a calibration then performed again by measurement, in order to check whether the product properties of the incoming product to be processed have changed, so that an adaptation of the operating time interval is necessary. As a result of the shortened operating time interval in comparison with the calibrating time interval, the solids collecting chamber of the separator is therefore preferably evacuated earlier, and the clear phase has product parameters—here in particular the degree of turbidity—that remain virtually the same over the course of the operating time interval.

The aforementioned steps of the method serve for controlling the operation of a separator. However, the individual method steps do not necessarily have to be carried out in a structural unit of the separator, they may alternatively be carried out by external devices (measuring devices, sensors, evaluation unit).

It may be required to adapt the aforementioned operating interval from time to time to changes of the properties of the clear phase as a consequence of changes in the properties of the incoming product—in particular if it is a natural product such as a cider or must to be clarified or a fruit or vegetable juice or a beer or the like. Such a change in the properties may occur, for example, during the processing of natural products containing turbid substances that have previously been stored in a tank. In this case there forms a sediment with greater amounts of turbid substances. If liquid is fed to the separator as a starting product from the region of the sediment, the content of solids becomes higher and the solids must be evacuated more often. It is therefore of advantage if, after a predetermined number of passages of operating time intervals, a renewed run-through of steps a)-d) takes place and the operating interval is adapted to the current measurement.

It is optionally also advisable if parameters of the starting product are included in the method according to the invention. For instance, a determination of the volumetric feed flow or a product parameter of the starting product fed to the separator may be performed and a renewed run-through of steps a-f) take place if the volumetric flow changes or the product parameter changes beyond a limit value.

The product parameter of the clear phase may be not only the degree of turbidity but also some other measurable parameter, such as the viscosity and/or the conductivity. Sensors or measuring devices with correspondingly designed sensors for determining these parameters can be attached comparatively easily to the separator at the corresponding outlets.

It is of advantage if the operating time interval is chosen in such a way that, within the operating time interval, the product parameter of the clear phase directly before the evacuation deviates by less than 50%, preferably less than 20%, from the product parameter of the clear phase directly after the solid discharge. If for example the degree of turbidity was chosen as the parameter, it has been possible until now—as also emerges, inter alia, from FIG. 2—for just one solid discharge or one solid evacuation to take place if the degree of turbidity of the clear phase toward the end of the time interval in which the solid matter is collected in the separator reached a multiple of the degree of turbidity of the clear phase directly after the evacuation. This excessive increase in the degree of turbidity of the clear phase shortly before the evacuation is prevented by the novel setting of the operating interval.

Ideally, the operating time interval is less than the calibrating time interval by at least 5%, preferably at least 10%.

As is usual with a discontinuous solid discharge, the solid discharge preferably takes place through discharge openings in the manner of nozzles, which can be closed and opened by a piston slide valve. This has the advantage in particular that the opening state of the discharge nozzles is precisely controllable.

The determination of the calibrating time interval and the operating interval and the setting of the operating time interval are preferably performed using an evaluation unit formed as a software routine of a control computer that is connected to the sensors and allows an activation of the actuating mechanism of the piston slide valve in the drum.

An exemplary embodiment of the invention is directed to a method for clarifying a flowable starting product (AP) with a centrifuge, in particular a separator with a rotatable drum with a feed and at least one liquid discharge for continuously discharging at least one clarified liquid phase—a clear phase—and with discontinuously openable solid-discharge openings for discontinuously discharging the solid phase, which has at least the following steps: a) preferably setting or determining a starting time; b) repeatedly determining/measuring at least one actual value of a product parameter of the clear phase (KP) drawn off from the drum; c) determining and evaluating the difference quotient from the determined product parameters and the respective time intervals between the measurements; and d) initiating a solid discharge as a consequence of the evaluation in step c).

After step d), steps a) to d) preferably start anew.

According to the alternative solution of features c) and d) of the embodiments, the increase in the product parameter, in particular the increase in the turbidity, is not directly detected, but instead the difference quotient from the measured values of the product parameter and the time intervals between the measurements is determined and evaluated.

Dependent on this evaluation, an evacuation is possibly initiated. Only if the behavior of this difference quotient (that is to say the variation of the numerical differentiation of the product parameter function, known only as an approximation in the form of discrete measured values, in dependence on time) deviates from a prescribed and prestored behavior, that is to say in particular if the difference quotient (or the first derivative) for example reaches or falls below or exceeds a prescribed limit value one or more times, is the evacuation initiated. According to claim 1, steps e) and f) are then run through, i.e. fixed times for one or more further evacuation intervals are defined. According to this embodiment, it is however also conceivable to run through steps a) to d) of this claim anew.

This procedure is considered more specifically on the basis of the example of the product parameter "degree of turbidity" in dependence on time. The degree of turbidity is determined in time intervals by a measurement. Then, the difference quotients from the degree of turbidity and the time interval between the respective measurements are determined and evaluated. A (numerical) detection of a change, for example an increase, in the difference quotient allows a conclusion to be made at a relatively early time, or advantageously detection of a commencing clearer or faster increase in the turbidity. In this situation, an additional solid evacuation is advisable. Also with this procedure, the risk of belated evacuations can consequently be prevented.

The method of this embodiment also allows further conclusions to be made. For instance, it may be that it is found in the evaluation of the difference quotient that it changes only very little over a relatively long time period. This may have the following cause. In the case of a very slow increase in the solid content in the separator drum, there is the risk of the disk stack in the separator drum gradually being covered with solids. This is the reason for the demonstrated continuous increase in the turbidity or the degree of turbidity ("sawtooth effect") and the dynamic limit value in the course of a day. In this case, it is conceivable that solids have already been discharged repeatedly, although the proportion of solids is in fact not yet as high as it should be in the case of an evacuation. It is consequently advisable to carry out an evacuation at an earlier time than intended. In this situation, it appears to be advantageous to define the limit value from the behavior of the derivative of the turbidity function in dependence on time. This is so because an evaluation of the derivative function makes it possible to distinguish the very slow increase from other increases.

Other effects that may influence the variation in the increase in the proportion of solids in the separator drum are a possibly necessary throttling of the feed rate, a possibly necessary flushing of the shroud or a pre-filling of a hydro-stop system. Also in these situations, too many solids could already be entrained into the liquid outlet for the liquid phase. Also in this situation, the alternative method provides an easy remedy. This is so because an evaluation of the derivative function makes it possible to detect the situations described.

It is optionally also conceivable in the event of a decrease in the turbidity or in the event of a turbidity remaining the same to carry out a renewed measurement and to discard values previously stored. In this way, inadmissible evacuations that could for example otherwise occur in the event of changes in pressure surges or changes in through-flows in the system can be prevented.

BRIEF DESCRIPTION OF THE DRAWING FIGURES

The invention is explained more specifically below on the basis of a preferred exemplary embodiment with reference to the appended drawings, in which.

DETAILED DESCRIPTION

Figure 1:
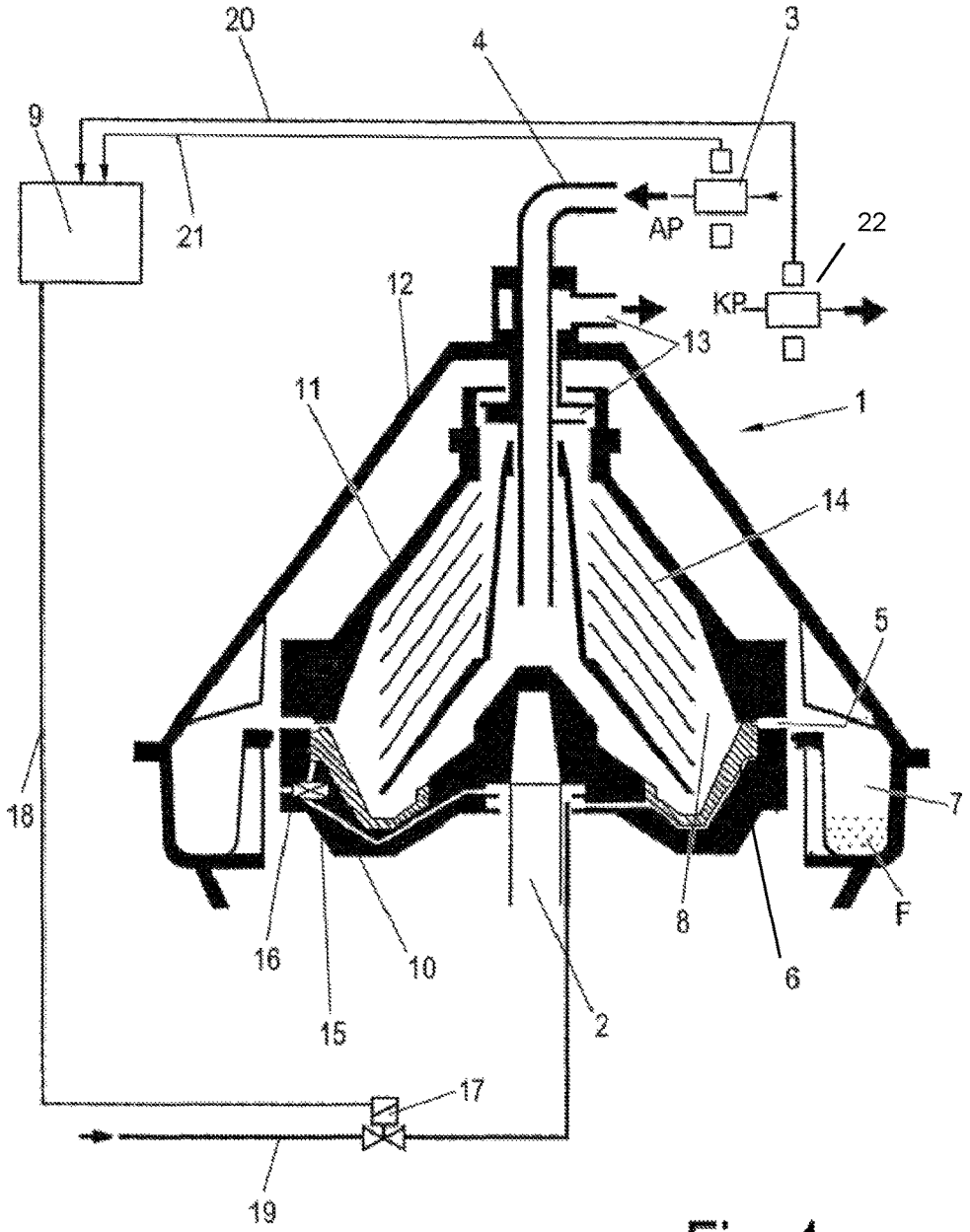
FIG. 1 illustrates a schematic sectional view of a separator that is operated by the method according to the invention.

FIG. 1 shows a separator 1 for clarifying flowable starting products AP containing turbid substances, with a drum with a vertical axis of rotation. The processing of the product takes place in continuous operation. In other words, the product feed takes place continuously and so does the drawing off of at least one clarified liquid phase, known as the clear phase.

The separator has a discontinuous solid discharge, the solid matter F that is separated from the starting product by clarification being removed at intervals by the opening and re-closing of discharge nozzles or discharge openings 5.

The drum has a lower drum part 10 and a drum cover 11. It is also preferably surrounded by a shroud 12. The drum is also mounted on a drive spindle 2, which is rotatably mounted and can be driven by a motor.

The drum has a product feed 4, through which a starting product AP is directed into the drum. It also has at least one outlet 13 with a gripper, which serves for drawing off a clear phase KP from the drum. The gripper is a kind of centripetal pump. The liquid discharge could, however, also take place by other means. Moreover, it would also be conceivable to perform in addition to the clarification also a separation of the product into two liquid phases of different densities. For this purpose, a further liquid outlet would be required.

The rotatable drum with a vertical axis of rotation preferably has a disk stack 14 comprising axially spaced apart separating disks. Formed between the outer circumference of the disk stack 14 and the inner circumference of the drum, in the region of its greatest inside diameter, is a solids collecting chamber 8. Solids that are separated from the clear phase in the region of the disk stack 14 collect in the solids collecting chamber 8, from which the solids can be discharged from the drum by way of the discharge nozzles 5. The discharge nozzles 5 can be opened and closed by means of a piston slide valve 6, which is arranged in the lower drum part 11. With the discharge nozzles open, the solid matter F is directed out of the drum into a solids catcher 7.

For moving the piston slide valve, the drum has an actuating mechanism. Here, this mechanism comprises at least one feed line 15 for a control fluid such as water and a valve arrangement 16 in the drum and further elements outside the drum. This makes it possible for the control fluid such as water to be fed by way of a control valve 17 arranged outside the drum, which is arranged in the feed line 19 for the control fluid arranged outside the drum, so that, for an evacuation, the control fluid can be injected into the drum by releasing the control valve or, conversely, the flow of control fluid can be interrupted in order to move the piston slide valve correspondingly to expose the discharge openings. The actuating mechanism—here the control valve 17—is connected by way of a data line 18 to a control unit 9 for the open-loop or closed-loop control of the solid discharge.

Arranged at or in the outlet 13 of the clear phase there is at least one sensor 22, which is designed to determine one or more product parameters of the at least one clear phase. Product parameters in connection with the present invention are, in particular, physical properties of the "clear phase" measuring medium, such as the degree of turbidity, the viscosity or else the conductivity (for example in the case of salt solutions). The at least one sensor 22 may be a photocell for determining the light transmissivity.

Arranged at or in the feed 4 for the starting product AP into the drum there is preferably likewise a sensor 3 for determining the through-flow of one or more product parameters of the starting product to be directed into the drum. These product parameters may also be physical parameters, such as the turbidity or the viscosity of the starting product.

Such measuring methods may also be carried out using sensors as transmission measurements or scattered-light measurements. A further possibility for determining the degree of turbidity is the use of ultrasound measurements.

By contrast, method parameters such as the volumetric through-flow or through-flow rate are also known. In a preferred configurational variant, the sensor may be respectively integrated in a measuring device, which determines a product parameter, for example the degree of turbidity or the conductivity, and at the same time determines a method parameter—such as for example the through-flow rate of the clear phase.

As already mentioned, by analogy with the determination of the product parameters of the clear phase KP, in a particularly preferred variant a turbidity measurement and/ or a viscosity measurement of the starting product AB may be performed at the product feed 4.

The sensors 3 and 22 are connected by way of data lines 20, 21 to the evaluation and control unit 9 (preferably a control computer of the separator), which evaluates the determined measured values and controls the movement of the piston slide valve 6, and consequently also the time interval until the opening of the discharge nozzles 5.

It goes without saying that the aforementioned data lines 18, 20, 21 make a data transmission from or to the evaluation unit 9 possible, and can even be replaced by wireless connections.

The method according to the invention, which is carried out by the separator described above, is described more specifically below, the degree of turbidity having been chosen in the present exemplary embodiment as the product parameter.

The starting product AP is directed, preferably continuously, into the separator, where it is clarified. A continuous clear-phase discharge of the clear phase KP takes place.

During the clarification of the starting product AP, with the formation of the clear phase KP, turbid substances contained in the starting product and other solids are collected in the solids collecting chamber 6 of the separator, which fills up. When too much solid matter has collected in the collecting chamber 6, it begins to be discharged with the clear phase (FIG. 2), which should be avoided as far as possible.

In order to monitor the clarification, until now the measurement and determination of the degree of turbidity has been carried out by a measuring cell. This involved presetting a limit value for the turbidity value that was not to be exceeded and then performing an evacuation of the solid matter F from the solids collecting chamber 6 whenever the determined turbidity value exceeded the limit value.

According to a configurational variant of the method as provided by the invention, as before, first an determination is performed of the time interval from the last evacuation of the solids chamber 7 of the separator 1 up to the reaching of a prescribed first turbidity limit value. This method step is subsequently referred to as the determination of a calibrating time interval. The calibrating time interval is defined as the time between the last evacuation of the solids chamber of the separator up until the reaching of the first degree of turbidity limit value. As soon as the measured turbidity content has reached the first limit value, an evacuation of the solids chamber 7 takes place. The evacuation of the solids chamber 7 during this method step is controlled by the measurement and reaching of the setpoint value.

After the determination of the calibrating time interval, an operating time interval is set. The operating time interval can be determined by subtracting a prescribed time interval from the calibrating time interval. After passing the certain operating time interval, a solid evacuation then takes place in a time-controlled manner. As a result, an increase in the degree of turbidity is as it were pre-empted and it is ensured that the quality of the clear phase is almost constantly good. A measurement of the turbidity content during this method step is not absolutely necessary but is conceivable, in order to intervene if, contrary to expectations, the limit value is possibly reached prematurely.

After repeated, for example n successive, passages of the operating time interval, each time with a subsequent evacuation of the solids chamber 6, it can happen that the degree of turbidity of the clear phase increases again. In this case, n may vary preferably between 5 and 50, particularly preferably between 8 and 30, passages. It is therefore recommendable after the nth passage of operating time intervals, to carry out a renewed determination of the calibrating time interval and renewed setting of the operating time interval.

The corresponding operations for evaluation of the measurement signals and also the open-loop and/or closed-loop control of the evacuation process are ensured by the evaluation unit 9.

Since, among the factors on which the degree of turbidity of the clear phase is based is the degree of turbidity of the starting product, it is advisable to also monitor the conditions at the feed of the starting product. For instance, the through-flow may be detected. It is also conceivable, however, to provide a measuring cell for measuring the feed flow at the feed 4. If this changes, a renewed determination of the calibrating time interval can be initiated.

Figure 2:
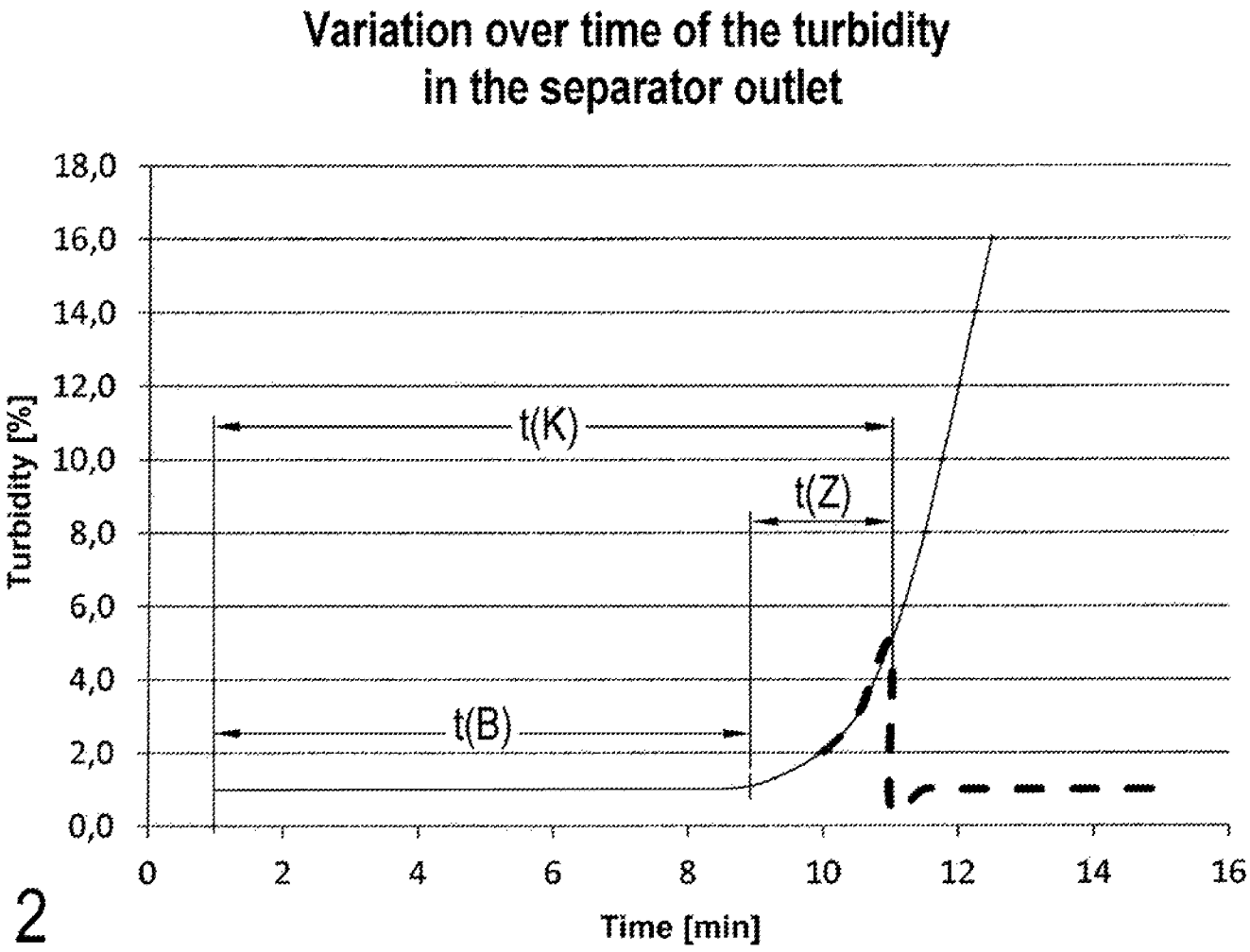
FIG. 2 illustrates, by way of example, a curve plotted over the course of a measurement from an application of the method according to the invention.

FIG. 2 represents the variation over time of the degree of turbidity T of the clear phase if the previous method is applied.

The turbidity or the degree of turbidity T is constant at one percent over the course of the 1st minute to the 9th minute. From the 9th minute, the degree of turbidity increases relatively rapidly. In the 11th minute, the setpoint value of 5% turbidity is reached and a solid evacuation takes place. As a result, the degree of turbidity consequently falls again to 1%. In this case, the time window t(K) represents the calibrating time interval.

The time interval may be set manually or be determined computationally or in dependence on measured values in a database. For example, the operating time interval t(b) may be determined by multiplication of the calibrating time interval by a factor of less than 1.

The time window t(B) represents the operating time interval. It can be seen that, in this time window, the turbidity is approximately constant at 1%.

Figure 3:
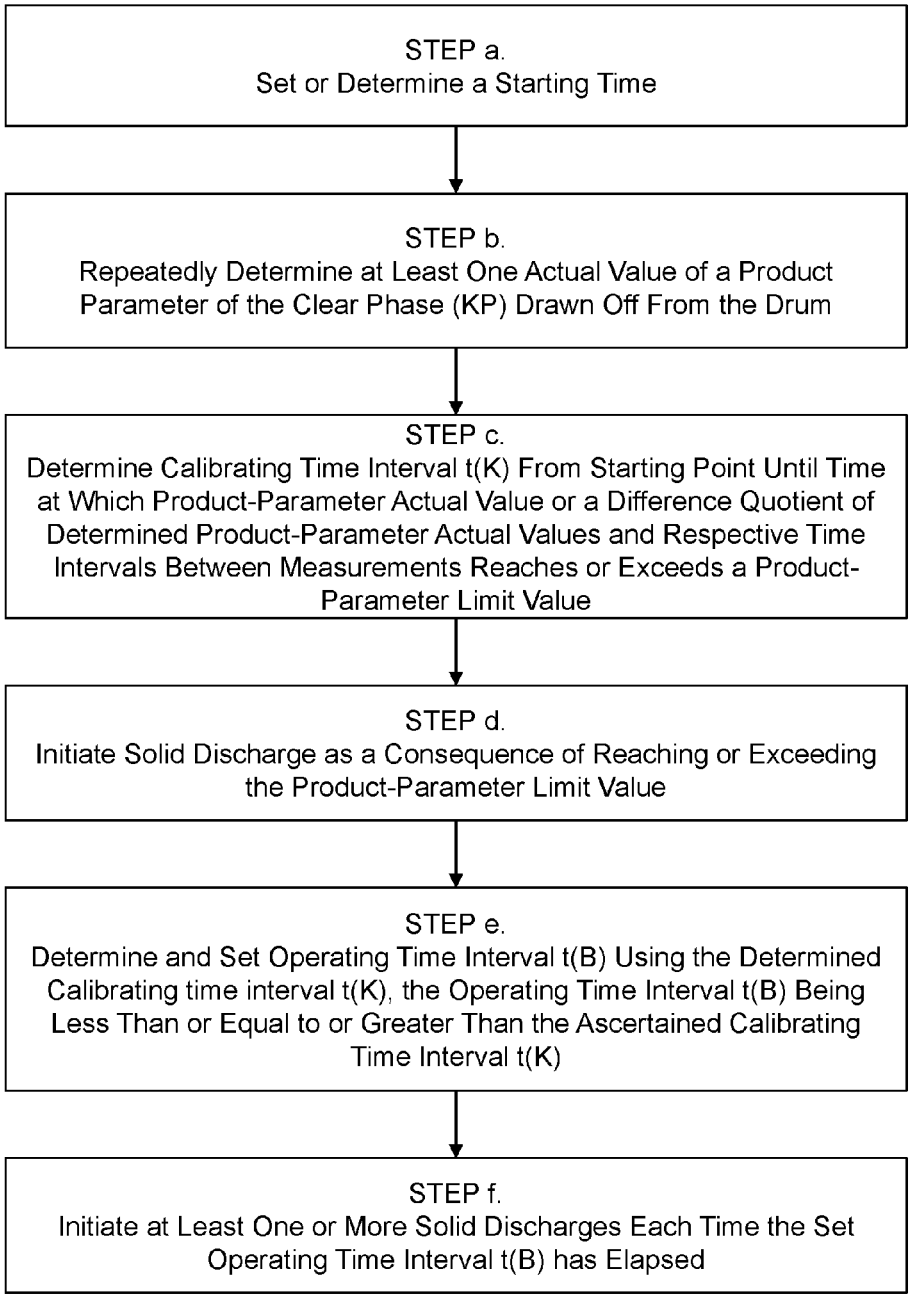
FIG. 3 illustrates a flow diagram relating to a method according to an embodiment of the invention.

FIG. 3 illustrates a sequence of steps of a method according to an embodiment of the invention. Specifically, in step a. a starting time is set or determined. In step b. repeatedly determining at least one actual value of a product parameter of the clear phase (KP) drawn off from the drum is repeatedly determined. Step c. involves determining the calibrating time interval t(K) from the starting point until the time at which the product-parameter actual value or a difference quotient of the determined product-parameter actual values and the respective time intervals between the measurements reaches or exceeds a limit value, in particular a product-parameter limit value. In step d. a solid discharge as a consequence of reaching or exceeding the limit value, in particular the product-parameter limit value is preferably initiated. Step e. involves determining and setting an operating time interval t(B) by means of the ascertained calibrating time interval t(K), the operating time interval t(B) being less than or equal to or greater than the ascertained calibrating time interval t(K). In step f. at least one or more solid discharges is initiated each time the set operating time interval t(B) has elapsed. After step f), the method can start again at step a) and run through these once again.

Figure 4:
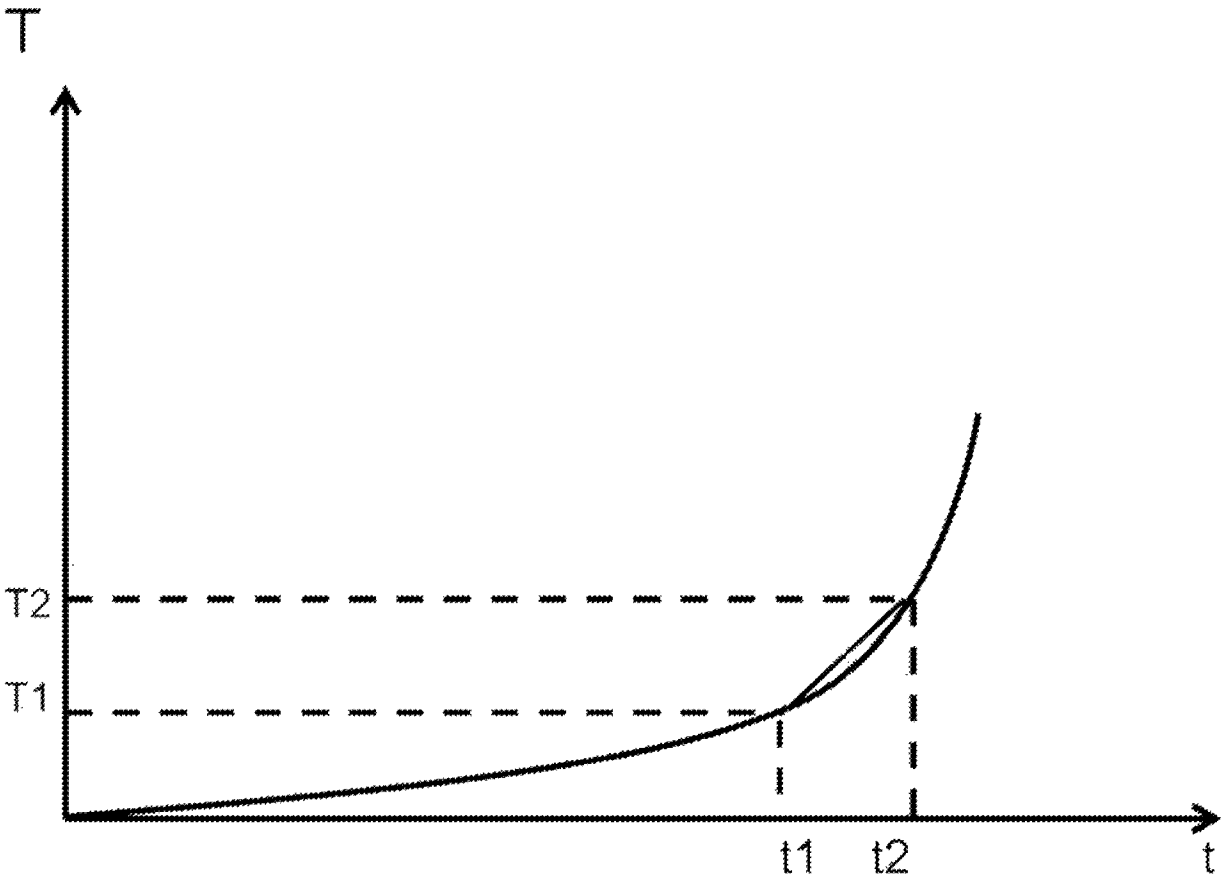
FIG. 4 illustrates, by way of example, a curve plotted over the course of a measurement from an application of a further method according to the invention.
Figure 5:
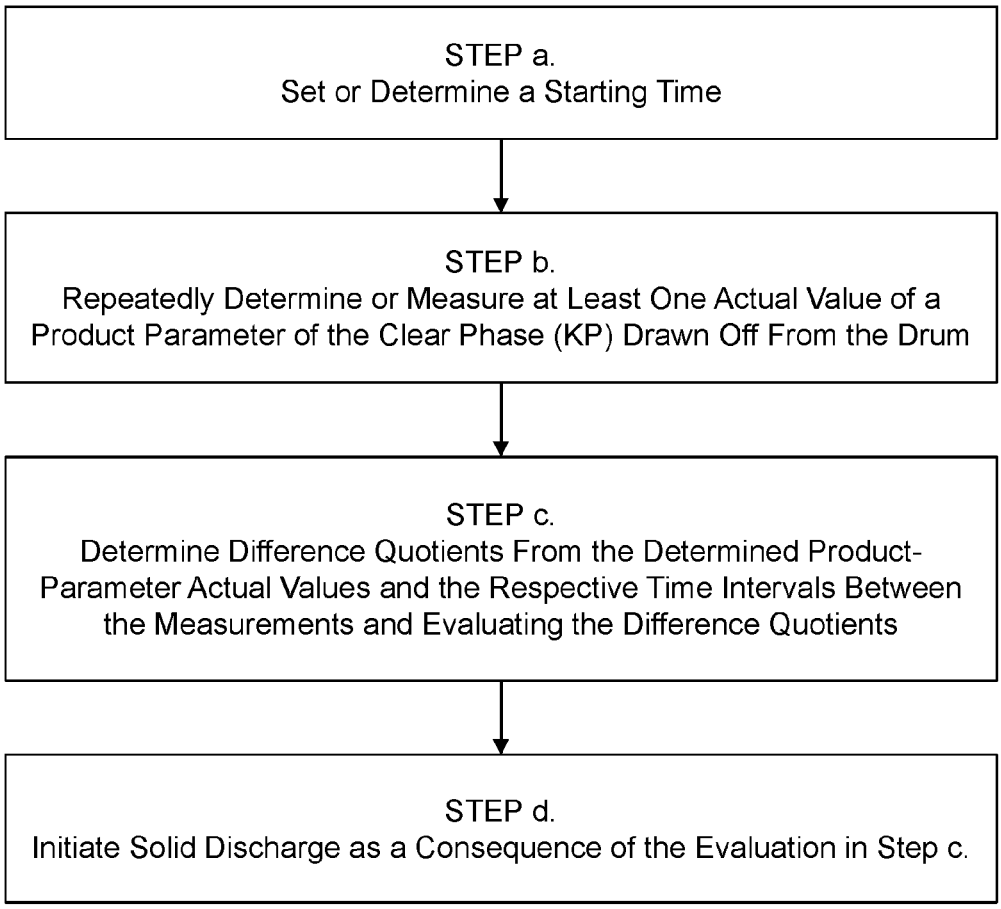
FIG. 5 illustrates a flow diagram relating to an alternative method of FIG. 4.

FIG. 5 illustrates a sequence of steps of a method according to an embodiment, which as illustrated by FIG. 4, is based on the example of the product parameter "degree of turbidity" in dependence on time. The degree of turbidity T is determined by measurements respectively carried out in time intervals. Specifically, in step a. a starting time is set or determined. In step b. at least one actual value of a product parameter of the clear phase (KP) drawn off from the drum is repeatedly determined or measured. Step c. involves determining difference quotients from the determined product-parameter actual values and the respective time intervals between the measurements and evaluating the difference quotients. In step d. a solid discharge is initiated as a consequence of the evaluation in step c).

Then, the difference quotients $$\Delta T/\Delta t$$

are determined from the measured values of the degree of turbidity $$\Delta T := T1 - T2$$

and the time intervals $$\Delta t := t2 - t1$$

between the respective measurements T2(*t*2) and T1(*t*1) and evaluated.

The detection of a change, for example an increase, in the difference quotient makes it possible at a relatively early time to detect a commencing more rapid increase in the turbidity. In this situation, an additional solid evacuation is advisable. Also with this procedure, the risk of belated evacuations can also be prevented.

LIST OF DESIGNATIONS

1 Separator
2 Spindle
3 Sensor
4 Feed
5 Discharge openings
6 Piston slide valve
7 Solids catcher
8 Solids collecting chamber
9 Evaluation unit
10 Lower drum part
11 Drum cover
12 Shroud
13 Outlet
14 Disk stack
15 Line for hydraulic fluid
16 Valve
17 Control valve
18 Data line
19 Hydraulic line
20 Data line
21 Data line
22 Sensor
KP Clear phase
AP Starting product
F Solids
t(K) Calibrating time interval
t(B) Operating time interval
t(Z) Preset time interval
n Number of successive passages of the operating time interval with subsequent solid discharge

The invention claimed is:

1. A method, comprising:

clarifying a flowable starting product using a separator with a rotatable drum, a feed, at least one liquid discharge for continuously discharging at least one clarified liquid phase, and discontinuously openable solid-discharge openings for continuously discharging the solid phase by a. setting or determining a starting time;

b. repeatedly determining at least one actual value of a single product-parameter of the at least one clarified liquid phase drawn off from the rotatable drum, wherein the single product-parameter of the at least one clarified liquid phase is one of degree of turbidity, a viscosity, and a conductivity;

c. determining a calibrating time interval from the starting time until a time at which the single product-parameter actual value of the at least one clarified liquid phase or a difference quotient of the determined single product-parameter actual values of the at least one clarified liquid phase and respective time intervals between the measurements reaches or exceeds a product-parameter limit value;

d. initiating a solid discharge via the solid-discharge openings in response to the determined actual value of the at least one clarified liquid phase reaching or exceeding the product-parameter limit value;

e. determining and setting an operating time interval using the determined calibrating time interval, wherein the operating time interval is less than the determined calibrating time interval; and f. initiating one of the plurality solid discharges each time the set operating time interval elapses.

2. The method of claim 1, wherein a time of a first solid discharge is determined in step a.

3. The method of claim 1, wherein steps a.-f. are only repeated after a predetermined number of passages of operating time intervals.

4. The method of claim 1, further comprising:

determining a volumetric flow or a product-parameter of the flowable starting product fed to the separator, wherein steps a.-f. are repeated if the volumetric flow changes or the product-parameter of the flowable starting product changes up to or beyond a limit value.

5. The method of claim 1, wherein the setting of the operating time interval is performed in such a way that, within the operating time interval, the product-parameter directly before the solid discharge deviates by less than 20% from the product-parameter directly after the solid discharge.

6. The method of claim 5, wherein the operating time interval is at least 10% less than the calibrating time interval.

7. The method of claim 1, wherein the solid discharge is initiated if the difference quotient reaches or falls below, or exceeds, a predetermined limit value one or more times.

8. The method of claim 1, wherein the solid discharge takes place through discharge nozzles, which are closed and opened by a piston slide valve.

9. The method of claim 1, wherein determination of the at least one actual value of the product-parameter of the at least one clarified liquid phase is performed by a sensor arranged in or at an outlet of the separator.

10. The method of claim 1, further comprising:

determining, using a sensor arranged in or at the feed of the separator, at least one actual value of a product-parameter of the starting product.

11. The method of claim 10, further comprising:

determining, by an evaluation unit, a calibrating time interval and operating time interval; and setting, by the evaluation unit, the operating time interval, wherein the evaluation unit is connected to the sensor and the evaluation unit allows a hydraulic setting of a position of a piston slide valve in the drum.

12. A method, comprising:

clarifying a flowable starting product using a separator with a rotatable drum, a feed, at least one liquid discharge for continuously discharging at least one clarified liquid phase, and discontinuously openable solid-discharge openings for continuously discharging the solid phase by a. setting or determining a starting time;

b. repeatedly determining at least one actual value of a product-parameter of the at least one clarified liquid phase drawn off from the rotatable drum;

c. determining a calibrating time interval from the starting time until a time at which the product-parameter actual value of the at least one clarified liquid phase or a difference quotient of the determined product-parameter actual values of the at least one clarified liquid phase and respective time intervals between the measurements reaches or exceeds a product-parameter limit value;

d. initiating a solid discharge via the solid-discharge openings in response to the determined actual value of the at least one clarified liquid phase reaching or exceeding the product-parameter limit value;

e. determining and setting an operating time interval for a plurality of solid discharges using the determined calibrating time interval and independent of further determinations of the product-parameter actual value of the at least one clarified liquid phase, wherein the operating time interval is less than the determined calibrating time interval; and f. initiating one of the plurality solid discharges each time the set operating time interval elapses.

13. The method of claim 12, wherein a time of a first solid discharge is determined in step a.

14. The method of claim 12, wherein steps a.-f. are only repeated after a predetermined number of passages of operating time intervals.

15. The method of claim 12, further comprising:

determining a volumetric flow or a product-parameter of the flowable starting product fed to the separator, wherein steps a.-f. are repeated if the volumetric flow changes or the product-parameter of the flowable starting product changes up to or beyond a limit value.

16. The method of claim 12, wherein the operating time interval is at least 10% less than the calibrating time interval.

17. The method of claim 12, wherein the solid discharge is initiated if the difference quotient reaches or falls below, or exceeds, a predetermined limit value one or more times.

18. The method of claim 12, wherein the product-parameter of the at least one clarified liquid phase and/or of the starting product is at least one of a degree of turbidity, a viscosity, and a conductivity.

19. The method of claim 12, wherein determination of the at least one actual value of the product-parameter of the at least one clarified liquid phase is performed by a sensor arranged in or at an outlet of the separator.

20. The method of claim 12, further comprising:

determining, using a sensor arranged in or at the feed of the separator, at least one actual value of a product-parameter of the starting product;

determining, by an evaluation unit, a calibrating time interval and operating time interval; and setting, by the evaluation unit, the operating time interval, wherein the evaluation unit is connected to the sensor and the evaluation unit allows a hydraulic setting of a position of a piston slide valve in the drum.

* * * * *